US006984185B2

(12) United States Patent
Nakane et al.

(10) Patent No.: US 6,984,185 B2
(45) Date of Patent: Jan. 10, 2006

(54) DEVICE FOR GUT STRINGING

(76) Inventors: Akifumi Nakane, 9, Kon-nan-cho, Hanazono, Ukyo-ku, Kyoto-shi, Kyoto (JP) 616-8056; Kazuo Ueda, 58-66, Hirono-cho Terayama, Uji-shi, Kyoto (JP) 611-0031

( * ) Notice: Subject to any disclaimer, the term of this patent is extended or adjusted under 35 U.S.C. 154(b) by 0 days.

(21) Appl. No.: 10/504,282

(22) PCT Filed: Feb. 24, 2003

(86) PCT No.: PCT/JP03/02004

§ 371 (c)(1),
(2), (4) Date: Aug. 11, 2004

(87) PCT Pub. No.: WO03/070330

PCT Pub. Date: Aug. 28, 2003

(65) Prior Publication Data

US 2005/0096160 A1 May 5, 2005

(30) Foreign Application Priority Data

Feb. 25, 2002 (JP) ..... 2002-048180

(51) Int. Cl.
*A63B 51/14* (2006.01)

(52) U.S. Cl. ..... 473/556

(58) Field of Classification Search ..... 473/555–557
See application file for complete search history.

(56) References Cited

U.S. PATENT DOCUMENTS 1,989,002 A * 1/1935 Doll ..... 473/556
2,032,217 A * 2/1936 Matthews et al. ..... 73/862.43
3,837,649 A * 9/1974 Burchett ..... 473/557
4,376,535 A 3/1983 Muselet et al.
4,484,742 A * 11/1984 McCrone et al. ..... 473/557
4,846,474 A * 7/1989 Chiang ..... 473/555
4,874,170 A * 10/1989 Zech ..... 473/557
5,120,056 A * 6/1992 Gharemani ..... 473/557
5,186,459 A * 2/1993 Korte-Jungermann ..... 473/539
6,712,723 B2 * 3/2004 You ..... 473/557
2003/0022740 A1 * 1/2003 You ..... 473/557

FOREIGN PATENT DOCUMENTS

EP 0 473 528 A1 * 3/1992
JP 59-11018 4/1984
JP 59-25416 7/1984

* cited by examiner

*Primary Examiner*—Raleigh W. Chiu
(74) *Attorney, Agent, or Firm*—Darby & Darby

(57) ABSTRACT

A device for easily and efficiently replacing the gut (1) of a racket, comprising a mechanism (11, 12) for clamping a frame (F) at least at one position and a tension head (H) for holding a part of the gut (G) loosely pre-tensed through a gut hole (71) and applying a tension thereto, wherein the clamp mechanism (11, 12) is installed on one side of a frame base (T) for mounting the racket thereon, the tension head (H) is disposed on the outer peripheral side of the frame (F) so as to be positioned close to and apart from the outer edge of the frame (F) and, when the tension is applied to the gut (G), the tension head (H) comes into contact with the outer edge of the annular frame (F) and holds the other side of the annular frame (F) by the tension applied thereto, and the clamp mechanism (11, 12) is formed so as to be rotatable generally around the center of the frame (F), and the tension head (H) is disposed slidably in the radial direction of the frame along a slide rail (R).

11 Claims, 9 Drawing Sheets

DEVICE FOR GUT STRINGING

This is a U.S. national phase application under 35 U.S.C. §371 of International Patent Application No. PCT/JP03/02004 filed Feb. 24, 2003, and claims the benefit of Japanese Patent Application No. 2002-48180 filed Feb. 25, 2002 which is incorporated by reference herein. The International Application was published in Japanese on Aug. 28, 2003 as WO 03/070330 A1 under PCT Article 21(2).

1. Technical Field

The present invention relates to a device for stringing a gut for a racket for badminton, tennis, or the like at a fixed tension. More specifically, the present invention relates to a compact and portable device for stringing a gut.

2. Background Technology

In badminton and tennis rackets, a gut is strung in a grid pattern on a frame to form the racket surface. This type of racket gut is generally strung in a roughly uniform manner with a fixed tension. The gut that forms the racket surface in this manner will inevitably break due to aggressive play or the lifespan of the gut. Restringing a gut also becomes necessary when the gut becomes loose or the user does not like the tension. Thus, although the frequency may vary, badminton and tennis rackets always involve restringing the gut.

Conventionally, restringing the gut has been a relatively difficult task to be performed by the player, who generally had to rely on specialists in sporting goods stores and the like to restring the gut. Restringing a gut is difficult because of the need to string the gut at a fixed tension, something which requires a relatively expensive and large machine.

The object of the present invention is to provide a device that allows gut restringing to be performed relatively easily while also providing a compact and portable device.

DISCLOSURE OF THE INVENTION

Resulting from various investigations made by the present inventor to overcome the problems described above, it was found that the problems could be solved with a device for stringing a gut for a racket including a plurality of gut holes formed along a ring-shaped frame. The device includes: a clamping mechanism clamping at least one position of the ring-shaped frame of the racket; and a tension head for holding a part of the gut loosely pre-tensed through a gut hole, the tension head applying tension to the gut. The clamping mechanism is attached to a frame base on which the racket is mounted. The tension head is disposed at an outer perimeter section of the ring-shaped frame so that the tension head can be abutted and moved away from an outer edge of the ring-shaped frame. When tension is applied to the gut, the tension head abuts the outer edge of the ring-shaped frame and supports at least one section of the ring-shaped frame.

In this type of device, the clamping mechanism is made pivotable around a position roughly at the center of the ring-shaped frame, and the tension head for applying tension is disposed slidably in the radial direction of the ring-shaped frame along a slide rail. As a result, the tension head acts as a slidable crimping clamp that clamps the frame. Thus, the frame can be clamped while the gut is pulled in a stable manner. Also, re-stringing of various types of rackets with different sizes of frames can be performed directly without requiring modifications to the device itself.

BRIEF DESCRIPTION OF THE FIGURES

FIG. 6 is a drawing showing a device according to an embodiment of the present invention in a disassembled state and shows an example in which the parts are housed in a case or the like.

DETAILED DESCRIPTION OF THE PREFERRED EMBODIMENTS OF THE INVENTION

The following is a description, with references to the drawings, of a gut-stringing device according to the present invention.

First, the structure of a gut-stringing device according to this embodiment will be described.

Figure 1:
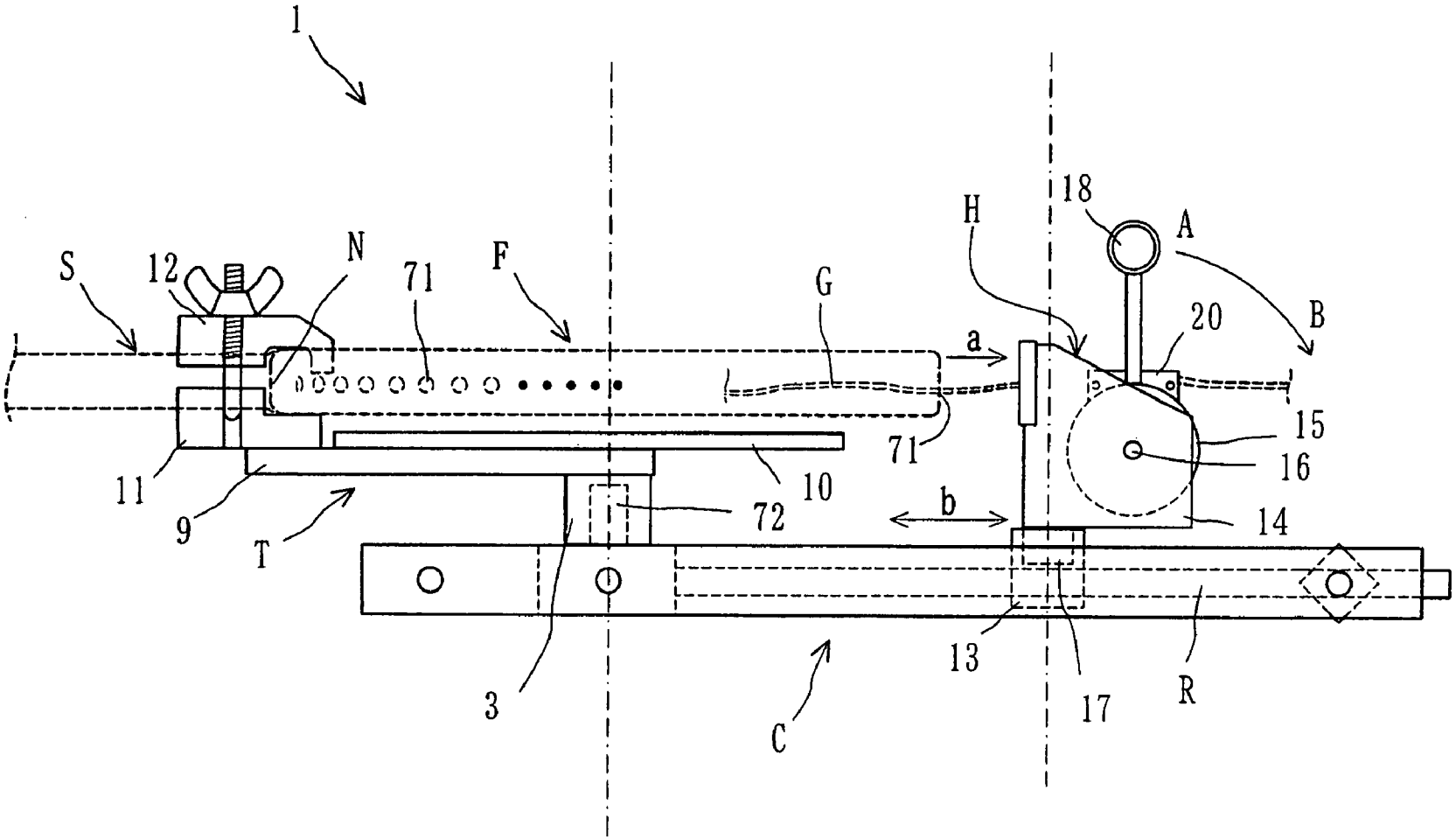
FIG. 1 is a side-view drawing showing an embodiment of the present invention.
Figure 2:
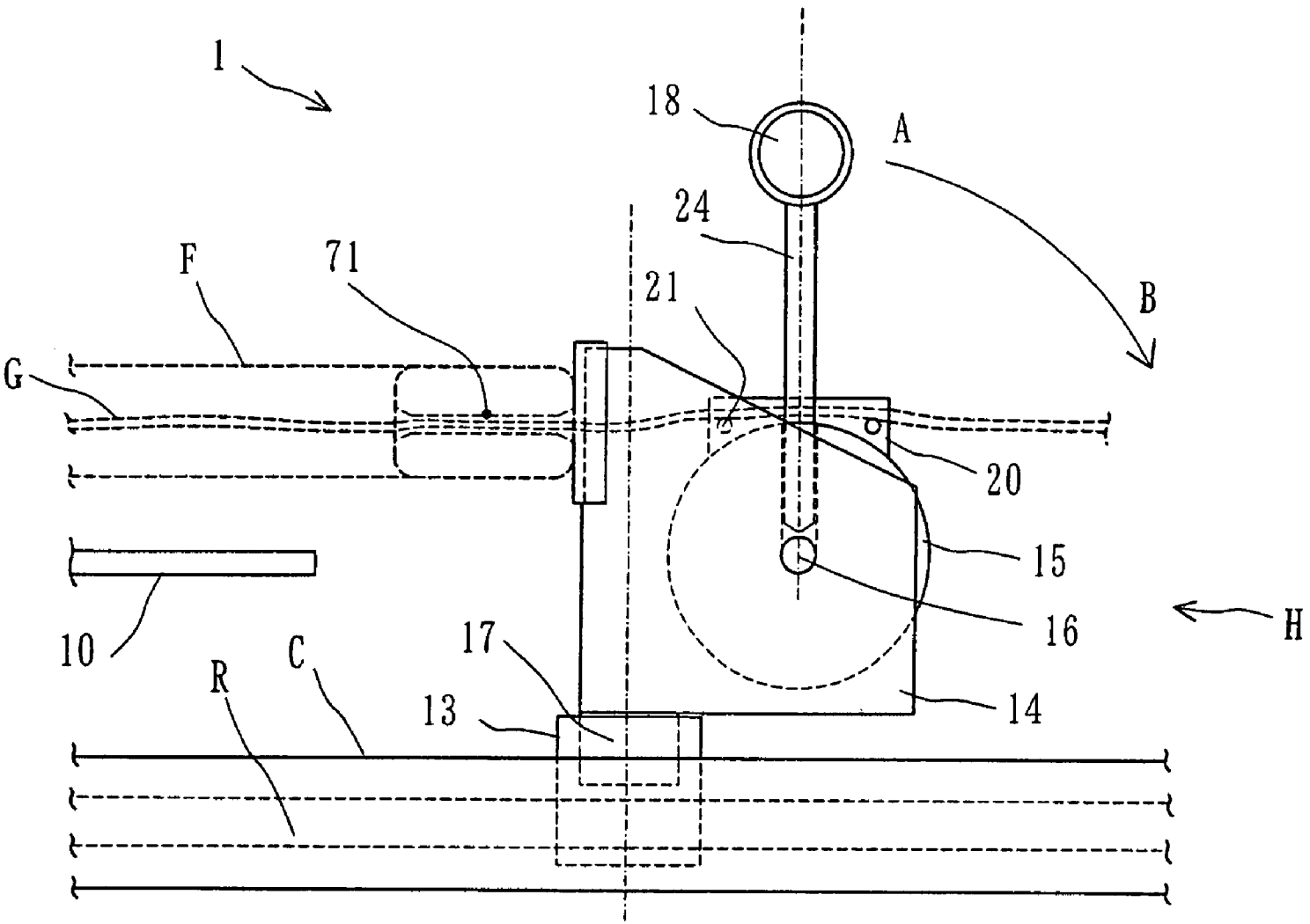
FIG. 2 is a detail drawing of FIG. 1.
Figure 3:
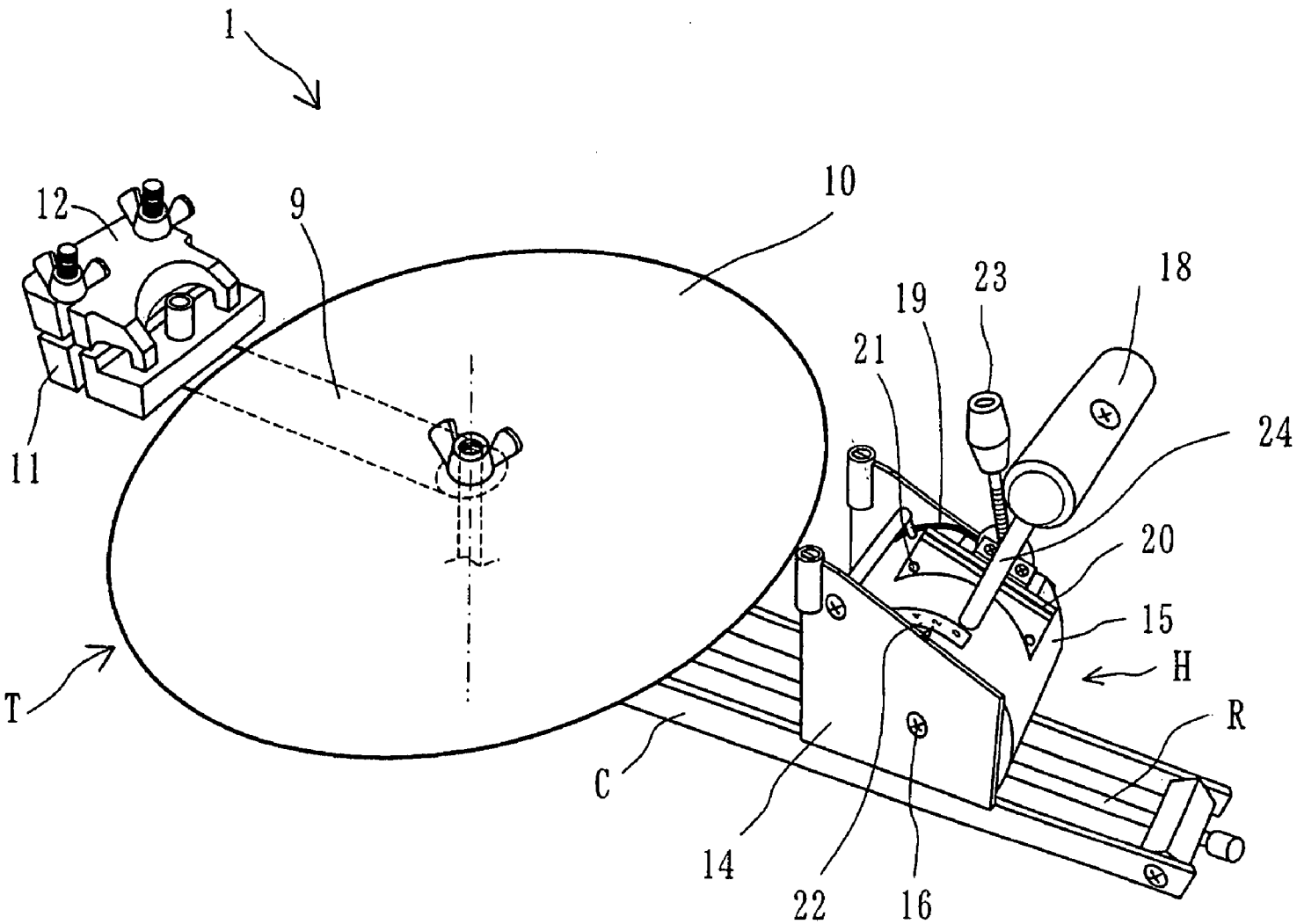
FIG. 3 is a perspective drawing showing an embodiment of the present invention.

FIG. 1 is a side-view drawing showing an embodiment of a gut-stringing device according to the present invention. FIG. 2 is a detail drawing of the same. FIG. 3 is a perspective drawing of the same.

In FIG. 1, there is shown a pedestal C serving as the base of this device. A tension head H clamps a gut G and applies tension in the direction of the arrow a. The tension head H is mounted so that it can slide in the direction of arrow b along a slide rail R disposed on the pedestal C. Upper and lower clamp members 11, 12 clamp one side of a ring-shaped frame F and are supported on one end of an arm 9, which is rotatably supported by a shaft 72 projecting from the pedestal C. The shaft 72 serves to rotatably support a bearing member 3 of a frame base T and is fitted in the bearing member 3 attached on the arm side. A disk 10 is made from a magnetic body and serves to magnetically secure a tension maintainer maintaining the tension of the gut when it has been strung using the tension head H. The central section of the disk 10 is secured on the bearing member 3. The tension maintainer will be described later. The bearing member 3, the arm 9, the disk 10, and the upper and lower clamp members 11, 12 are referred to as the frame base in this embodiment. The clamp members 11, 12 clamp a neck section N that serves as a connecting section between the frame F and a shaft S. The structure around the tension head H will be described using FIG. 2.

FIG. 2 is a detail drawing of FIG. 1 and primarily shows the structure around the tension head H.

In FIG. 2, there is shown a main unit 14 of the tension head H. A sliding member 13 is inserted in the slide rail R and allows the tension head H to be slidably attached. The sliding member 13 is also a member for rotatably supporting the main unit 14. The main unit 14 is fitted into a hole 17 formed on the upper portion of the sliding member 13. A puller 15 applies tension to the gut and, in the main unit 14, is rotatably supported around a rotation shaft 16. A gut clamping plates 20 are disposed on the outer perimeter of the puller 15. A projection 21 is used to come into contact with the gut and is disposed on a lower portion of the gut clamping plates 20. A manual turning lever 18 is used to apply pulling tension and is attached to the puller 15 by way of a shaft 24. When pulling the gut, rotational torque going from A to B is applied to the puller 15 by the manual turning lever. Threads are formed on part of the surface of the shaft 24, the end of which is formed to reach the rotation shaft 16. As a result, by turning the manual turning lever 18, the end of the shaft 24 is brought into contact with the rotation shaft 16, and the puller 15 can be temporarily secured at a desired rotation angle. Multiple gut holes 71 are formed in a regular pattern along the outer perimeter of the ring-shaped frame F for the racket. The structure for clamping the gut and the measuring of tension will be described using FIG. 3.

FIG. 3 is a perspective drawing of the device shown in FIG. 1 and FIG. 2. The frame F of the racket is omitted.

A gut-tightening mechanism 23 secures the gut so that it is immobile by having the gut inserted between two clamping plates 20. A cam operates to reduce the gap formed between the two gut clamping plates.

A return spring 19 serves to return the puller 15 to its initial position, one end thereof being engaged with the main unit 14 and the other end being engaged with the puller 15.

A scale 22 indicates the tension applied to the gut.

Means for measuring the tension applied to the gut will be described. In FIG. 3, (1) first, the gut is interposed between the two gut clamping plates 20 and this is secured by squeezing from both sides using the tightening mechanism 23. When doing this, slack in the gut between the frame F and the gut clamping plates is removed ahead of time. (2) The gut is stretched from this state. (3) The actual length of the stretched gut at this point corresponds to the tension applied to the gut, so this is used to measure the gut tension. In this embodiment, there is a pre-engraved scale 22 on the tension head H in which the pulled length is converted to tension (pounds). Thus, when the gut is pulled, the scale is read to measure the tension.

Figure 4:
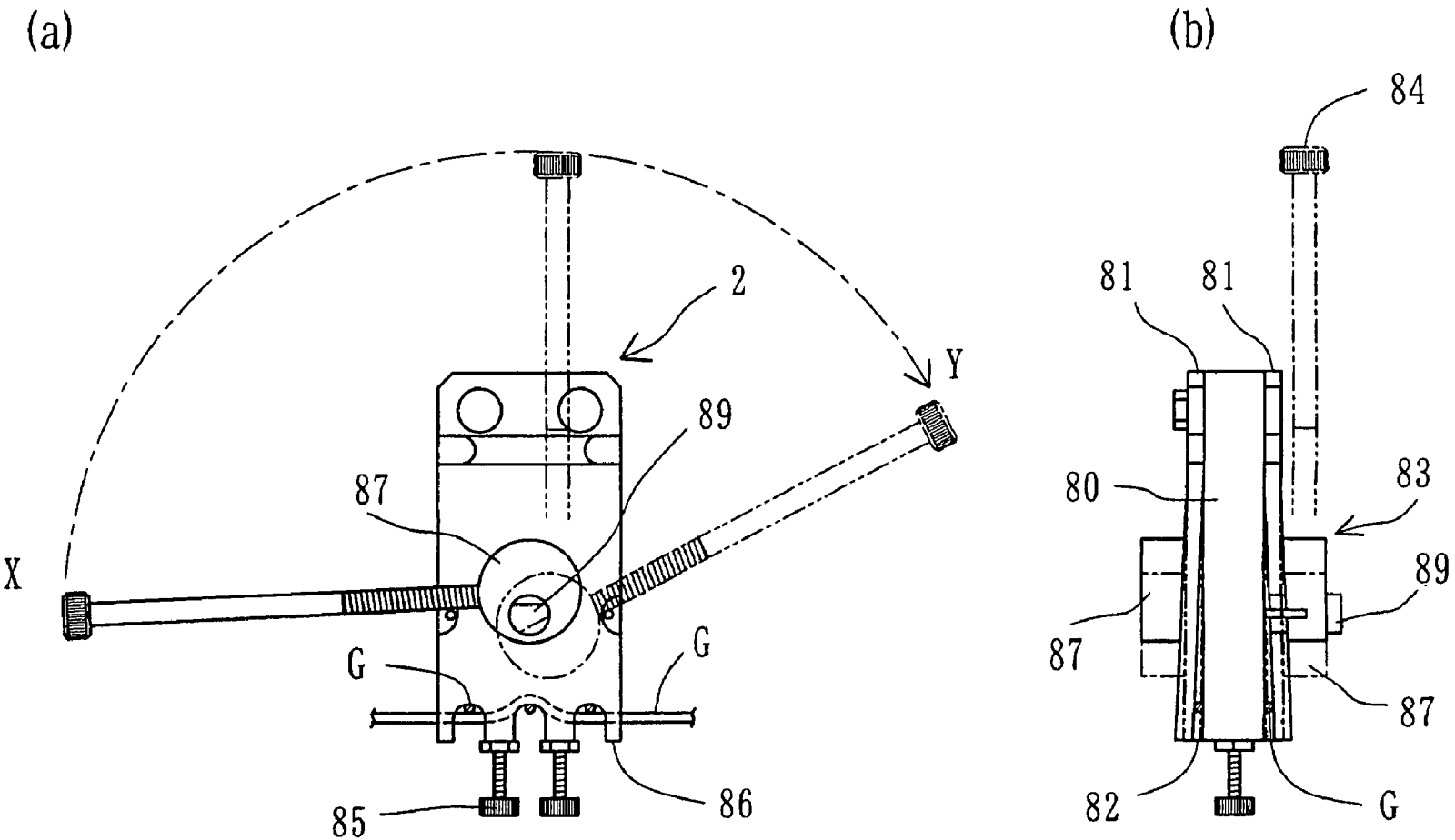
FIG. 4 and FIG. 5 are drawings illustrating the tension maintainer.
Figure 5:
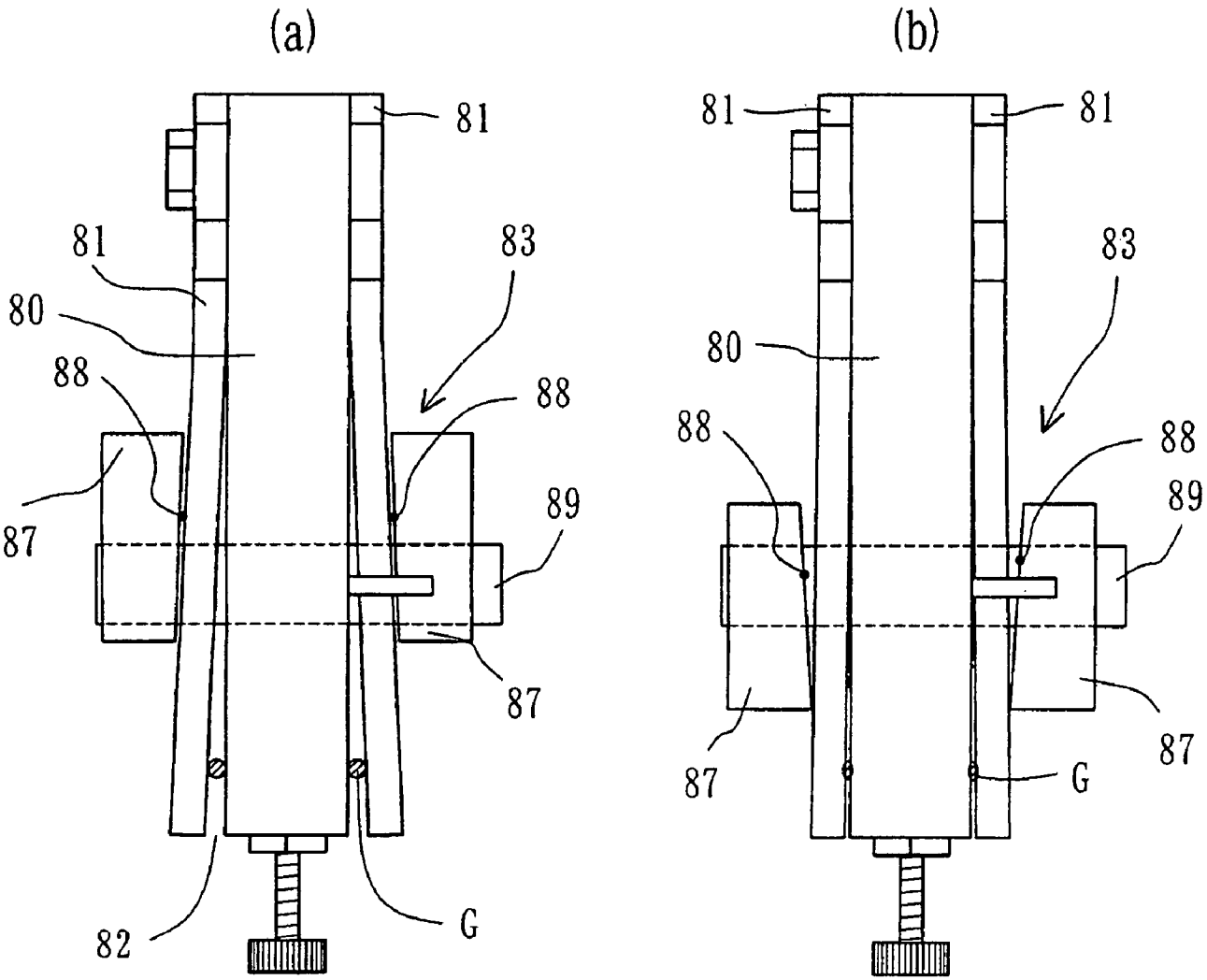

When using the device 1, the tension maintainer that maintains the pulled gut is also used so this will be described. FIG. 4 and FIG. 5 show an example of the structure of a tension maintainer.

FIG. 4(*a*) is a side-view drawing of the tension maintainer 2. FIG. 4(*b*) is a front-view drawing of the tension maintainer 2.

In FIG. 4(*a*) and FIG. 4(*b*), the tension maintainer 2 is formed from a middle plate 80, two clamping plates 81 disposed on either side thereof, and a tightening mechanism 83. These three plates are bonded toward the upper end section and form indentations 86 at the bottom end. At the bottom of the middle plate 80 are legs 85 to the ends of which are attached magnets. The structure of the tightening mechanism will be described using FIG. 5(*a*) and FIG. 5(*b*).

FIG. 5(*a*) is a detail drawing of FIG. 4(*b*) and illustrates when the knob 84 is at point X in FIG. 4(*a*). FIG. 5(*b*) is a front-view drawing of the tension maintainer 2 when the knob 84 is at the point Y in FIG. 4(*a*). The knob 84 is omitted from FIG. 5(*a*) and FIG. 5(*b*).

In FIG. 5(*a*) and FIG. 5(*b*), the tightening mechanism 83 is formed from a shaft 89 and two cams 87 attached thereto. The cams 87 are formed as short cylindrical shapes, and are engaged eccentrically to the shaft 89. The outer perimeter surface of the cam 87 is equipped with the knob 84. The shaft 89 passes through the middle plate 80 and the two clamping plates 81. A contact surface 88 of the cam 87 is at an angle relative to the shaft 89, and the contact surface 88 is in contact with the clamping plate 81. The middle plate 80 is formed from resin, the clamping plates 81 are metal plates formed from spring steel, and the shaft 89 and the cams 87 are formed from brass.

In FIG. 5(*a*) and FIG. 5(*b*), the knob 84 is turned from X to Y in FIG. 4(*a*). The cams 87 attached eccentrically to the shaft 89 rotate, and the rotational motion of the cams 87 is converted to linear motion that reduces the gap 82 between the clamping plates 81 and the middle plate 80. The gut G disposed in the gap 82 is tightly secured in this manner.

Figure 6:
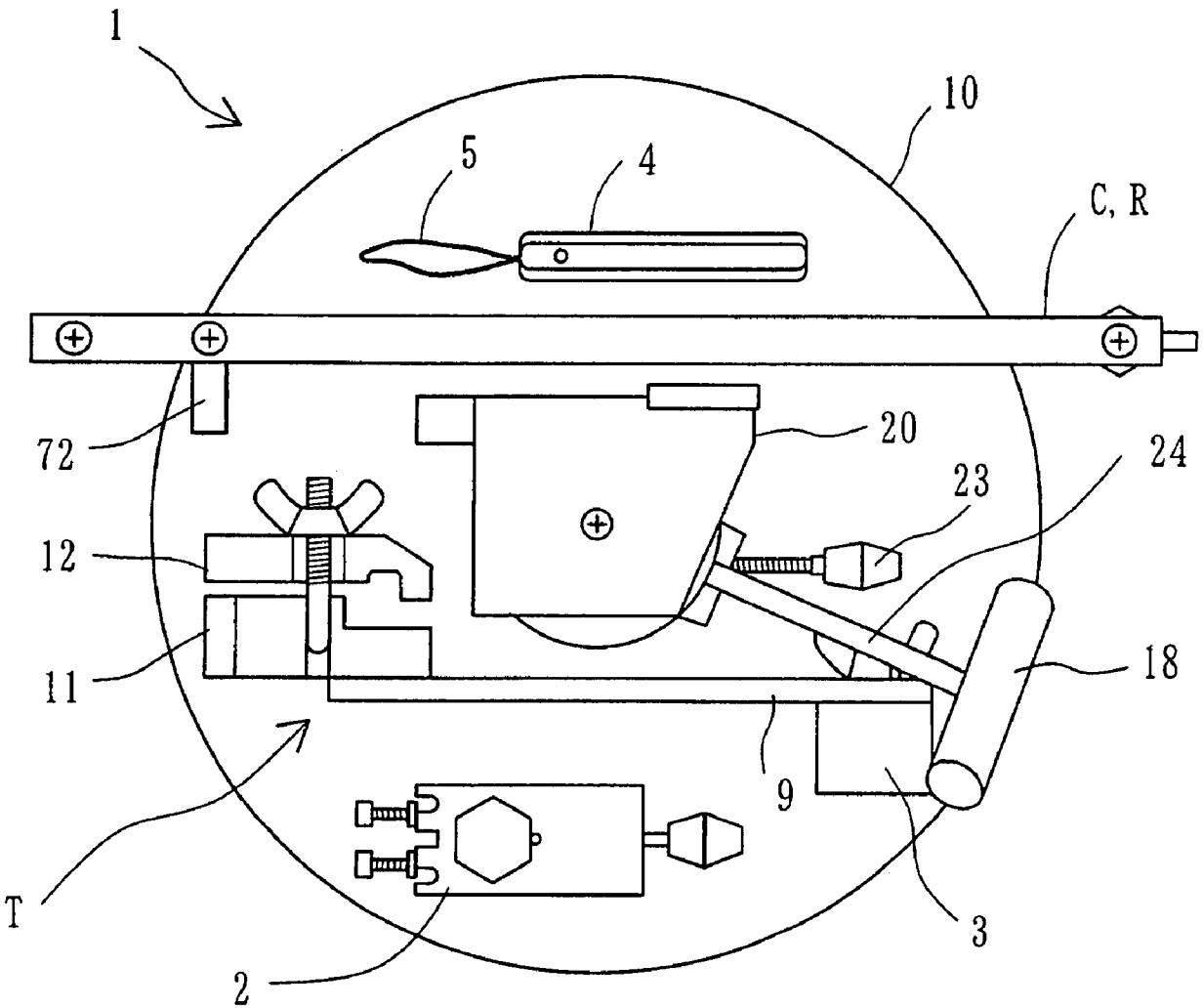

The device 1 according to this embodiment as described above is set up as a ready-to-assemble structure that can be stored in a compact manner as shown in FIG. 6.

In FIG. 6, there is shown a gut-threading tool 4 for passing the gut through gut holes. A ring 5 is formed at the end thereof. The ring 5, formed from piano wire with a diameter of approximately 0.2 mm, can hold its shape while being deformable into a desired shape. When inserting the gut in a gut hole: (1) The ring 5 of the gut-threading tool 4 is passed through the gut hole ahead of time. (2) The gut to be passed through the outer perimeter section and the inner perimeter section of the frame is inserted through the ring 5. (3) Then, the gut-threading tool 4 is pulled out from the gut hole. This allows the gut to be strung without damaging the gut hole.

Next, the manner in which the gut-stringing device described above is used will be described.

FIRST EXAMPLE

In the example described below, the stringing of separate guts going vertically and horizontally in the racket will be described. Two guts are used. First, a gut is strung vertically and stretched to form vertical gut columns. Then, the horizontal gut is also stretched in the same way. This will be described using FIG. 7 and FIG. 8.

Figure 7:
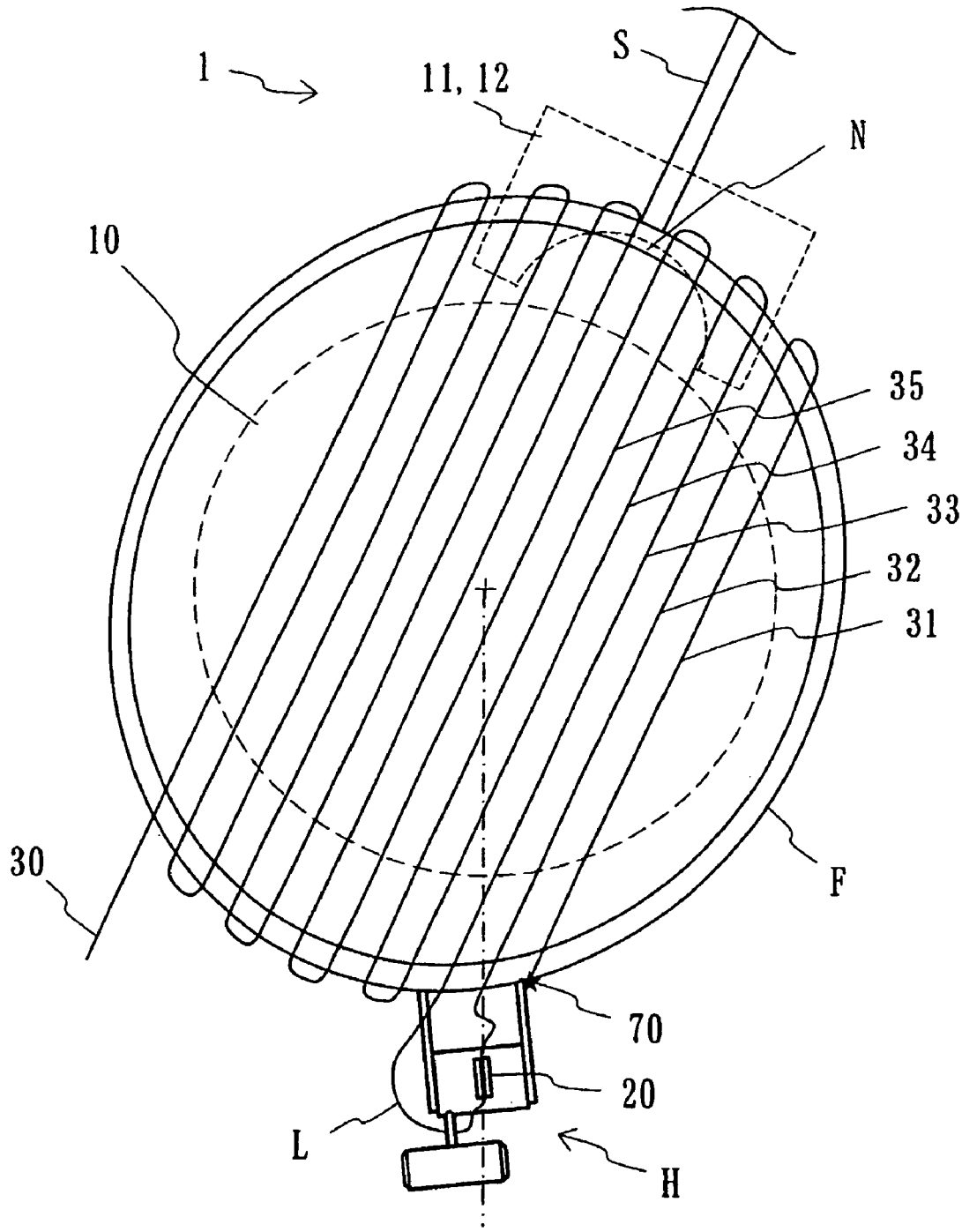
FIG. 7 and FIG. 8 show how a device according to an embodiment of the present invention is used.

FIG. 7 shows how the gut-stringing device according to this example is used. The racket is strung starting vertically. In this figure, the slide rail R is omitted. The center line along which the slide rail R moves is illustrated by the dashed dotted line, and the disk 10 and the upper and lower clamping members 11, 12 are illustrated by the dashed lines.

Before the gut-stringing operation is started, the vertical gut is extended as appropriate over the racket frame.

In FIG. 7, a gut 30 is loosely pre-tensed vertically on the racket. When mounting the gut, a knot 70 is formed ahead of time at one end of the gut. Then, the gut is passed through a gut hole. The vertical gut 30 is extended and passed through gut holes for a first column 31, a second column 32, a third column 33, a fourth column 34, and the like.

A loop L is formed between adjacent gut holes, and the loop L formed in this way is left loose.

After the extending of the vertical gut is completed, the neck section N of the racket is secured between the upper and lower clamping members 11, 12 of the frame base T.

Then, as shown in FIG. 7, the tension head H is positioned near a predetermined position of the frame F, i.e., the gut that is to be pulled in the beginning (the second row 32). The gut in the loop L is passed through the gap between the two gut clamping plates 20 and is secured from both sides. In this operation, the slack between the gut clamping plates 20 and the frame F is eliminated as much as possible. Then, the manual turning lever 18 is grasped and the gut is pulled. The tension applied to the gut can be read from the markings of the scale 22. Once the desired tension, e.g., 20 pounds, is reached, the puller 15 is held in place so that it remains in that position. This is performed by twisting the turning lever 18 and pushing the end of the manual turning lever shaft 24 against the rotation shaft 16. As a result, the puller 15 is held in place in opposition to the contraction of the return spring 19.

After holding the puller 15 in place, the tension maintainer 2 is inserted between the pulled gut 32 (from the second column) and the adjacent first column gut 31. While the tension maintainer 2 is inserted between the two adjacent guts (the first column 31 and the second column 32), the entire maintainer is magnetically secured to the disk 10 so that the tension applied by the puller 15 is maintained for this section of the gut.

With the tension being maintained with the tension maintainer 2, the gut is removed from the gut clamping plate 20 and the puller 15 that was being held in place is released. Then, adjacent vertical guts are stretched one after the other using the same procedure. For example, the slack in the loop L between the fourth column 34 and the fifth column 35 is first increased by tugging the gut extended across the third column and the fourth column. The tension head H is moved close to the gut hole of the gut 34 of the vertical fourth column, and the gut 34 at the fourth column is stretched in the same way that the gut 32 at the second column was stretched.

The operation can be performed smoothly if multiple tension maintainers 2 are used, with the stretched guts being clamped one after the other.

Once the stringing of the gut 30 along the vertical direction of the racket is completed, a gut 50 for the horizontal direction of the racket is extended.

Figure 8:
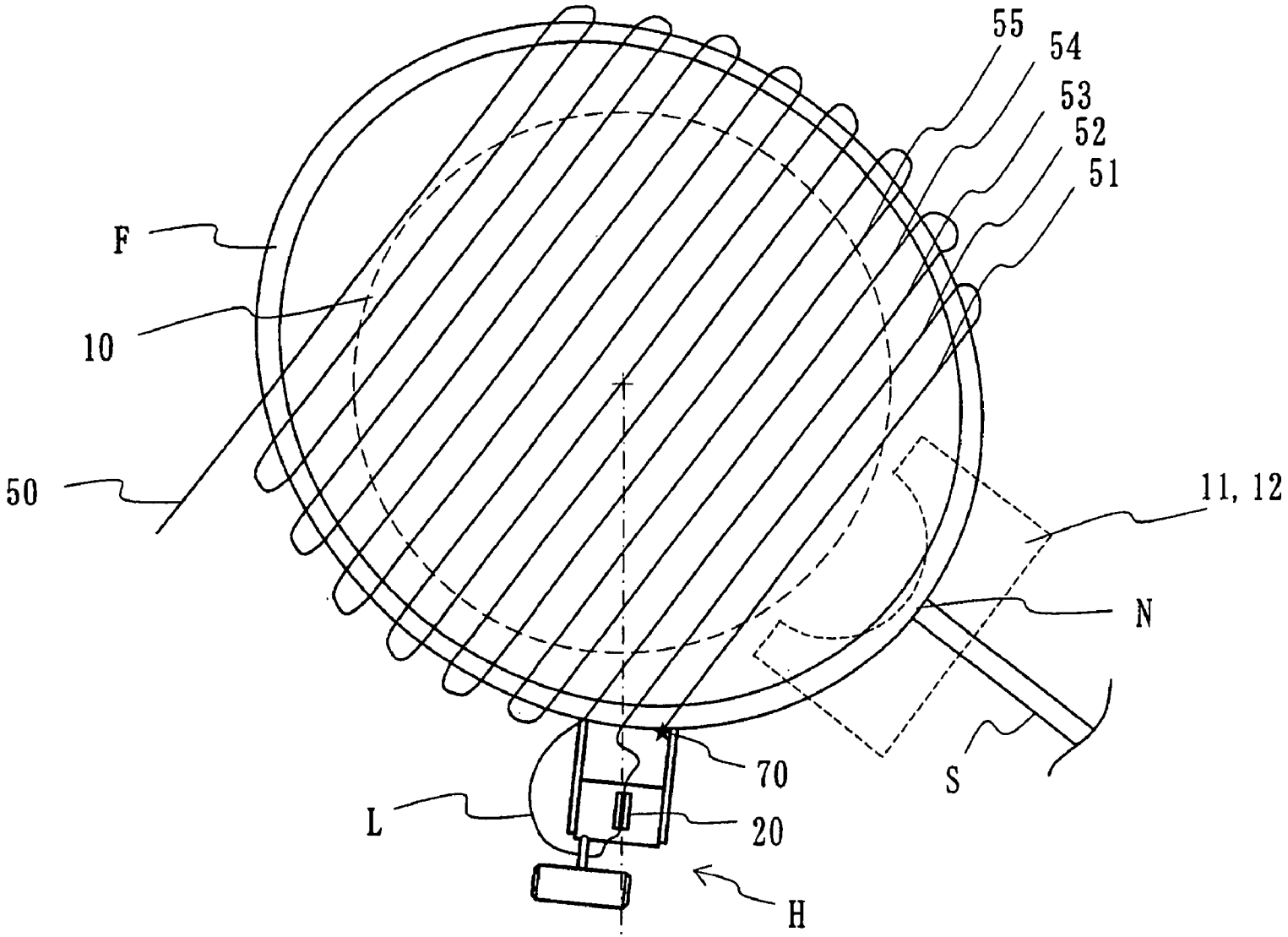

FIG. 8 shows the start of stringing the horizontal gut after the vertical gut has been tensed. In FIG. 8, the vertical gut 30 has been omitted.

FIG. 8 shows the horizontal gut 50, which has been loosely pre-tensed starting from the frame neck section N so that it has been woven through the mounted vertical gut 30. The horizontal gut can be stretched in the same manner as the vertical gut.

As FIG. 8 shows, when stringing the horizontal gut, the racket is first turned, and the tension head H is pressed against a predetermined position on the outer perimeter of the frame (near a second row 52 of the gut). The stretching operation is then performed, and the stringing of the gut is completed.

SECOND EXAMPLE

Figure 9:
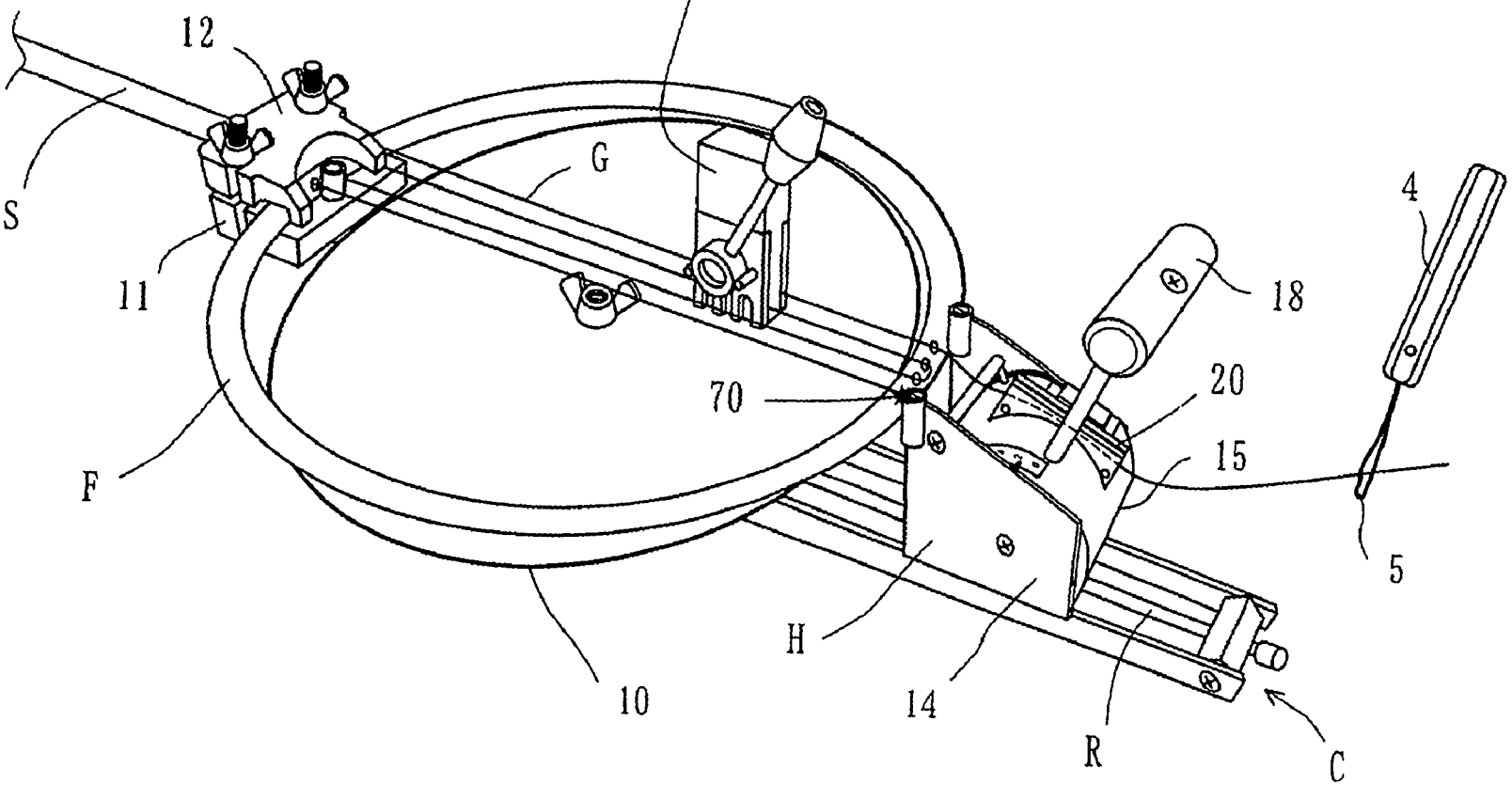
FIG. 9 is a perspective drawing showing an embodiment of the present invention being used.

In the example described above, the vertical or the horizontal gut has been loosely pre-tensed. In a different example descried below, the gut is mounted in the following manner: (1) a gut is extended across the racket; (2) the gut is stretched; (3) while maintaining tension, the gut for the next column is extended and steps (1) and (2) are repeated. FIG. 9 illustrates how the device is used in this example.

As FIG. 9 shows, in this example, the gut is pulled starting from the vertical center of the frame. The gut is formed with a knot 70 at one end and is passed through a gut hole ahead of time. The pulling of the gut begins after the gut has been extended for one round trip and is started from the gut at the second column. More specifically, the tension head H is set up near the gut hole through which the second column gut to be initially pulled passes. The second column gut is then secured by the gut clamping plates and pulled. The subsequent operations are similar to those of the first example. The puller 15 is held in place and the tension maintainer is placed between the first column gut and the second column gut to maintain tension. Then, the gut is extended across the third column and the fourth column and this time the fourth-column gut is pulled with the puller 15 to stretch the third-column gut and the fourth-column gut. The operation proceeds with the gut being extended across the sixth column, the eighth column . . . in the same way. Once the operation reaches the end of the frame, the rest of the vertical gut is mounted, and then the horizontal gut is mounted.

The structure and usage of the device 1 according to this embodiment was described. In the structure described above, the neck section N of the frame F is firmly clamped, so the frame can be adequately secured in a stable manner from just this one position. Since there is no need to clamp the outer perimeter of the frame F as in the conventional technology, the device does not need to be modified to secure various types of rackets with different frame sizes and shaft diameters.

In addition to the slide mechanism, the tension head H is equipped with a rotation mechanism so that when tension is to be applied to the gut, the tension head H can always be pressed against the outer perimeter surface of the frame F regardless of the rotation angle of the frame F. As shown in FIG. 7 through FIG. 9, when the gut is stretched while the tension head H is pressed against the outer perimeter of the frame, the reaction to the pulling causes the tension head H to be pulled toward the frame, resulting in tighter contact. Thus, the gut can always be stretched in a stable manner. Since the tension head H clamps the frame at the same time, it also serves as a slidable crimping clamp. Because of this, the device can be used with no modification to re-gut various rackets having frames of different sizes.

In this embodiment, the neck section N of the frame F is clamped with the upper and lower clamp members 11, 12, and the frame F is secured just from this position. However, the clamping mechanism is not restricted to this, and it would also be possible to have the outer perimeter of the frame F supported at two or more positions to secure the frame F. In this type of structure, deformation to the frame when the gut is pulled with a high tension can be prevented. An example of this structure could be multiple arms that are essentially level extending radially from the bearing member 3 with support poles formed at the ends thereof to support the outer perimeter of the frame. Adjustable tightening means can be set up at the sections of the support poles corresponding to the outer frame perimeter so that different types of frames can be supported.

Besides supporting the frame with clamping mechanisms and tension heads, it would also be possible to prevent frame deformation due to the gut being pulled at a high tension by using a well-known frame deformation preventing means in which the frame is tightly supported from its perimeter along a plane essentially perpendicular to the direction in which tension is applied to the gut.

The device according to this embodiment is used together with the tension maintainer 2. Since the legs 85 are magnetically secured to the disk 10, the tension maintainer is mounted so that it is secured to the frame base T while supporting the gut. Also, since the indentations 86 are formed on the lower section of the tension maintainer 2 according to the grid dimensions of the gut, the gut can be secured without any obstruction from the gut extending perpendicular thereto.

The present invention is not restricted to the structure of the embodiment described above. In the embodiment described above, the frame base T and the frame F secured thereto are rotated, but it would also be possible to provide similar advantages by having, conversely, the tension head H be rotatable around the frame F. also, the means for measuring the tension applied to the gut is not restructured to the example described above. It would also be possible to have a suitable signal sent to the user when the tension applied to the gut reaches a desired value. For example, when the tension applied to the gut reaches a desired value, a latch could be released so that a suitable signal is sent to the user. Alternatively, a lamp can be turned on when a desired tension is reached.

FIELDS OF USE IN INDUSTRY

By using the gut-stringing device according to the present invention described above, anyone can easily string a gut in a substantially uniform manner. Also, as shown in FIG. 6, the parts can be stored and carried in a compact manner, thus allowing the device to be easily carried while traveling. This contributes to an atmosphere where the player can concentrate on training. Also, since the tension head also serves as a slidable crimping clamp that clamps the frame, the gut can always be stretched in a stable manner while the frame is clamped. In addition, gut-stringing can be performed even if the environment does not allow a large gut-stringing machine to be used, making the device useful in emergency situations.

What is claimed is:

1. A device for stringing a gut for a racket including a plurality of gut holes formed along a ring-shaped frame, comprising:

a clamping mechanism for clamping at least one position of said ring-shaped frame of the racket, an arm attached to the clamping mechanism, said arm connected to a shaft pivotally disposed at a position approximately at the center of said ring-shaped frame, said clamping mechanism configured to pivot around a position approximately at the center of said ring-shaped frame;

a tension head for holding a part of the gut loosely pre-tensed through a gut hole, said tension head applying tension to said gut;

wherein:

said racket is disposed above said arm and attached to said clamping mechanism;

said tension head is disposed at an outer perimeter section of said ring-shaped frame such that said tension head is adapted to slidably abut or move away from an outer edge of said ring-shaped frame;

when tension is applied to said gut, said tension head abuts said outer edge of said ring-shaped frame, and said tension head further supports at least one section of said ring-shaped frame by means of an applied tension.

2. A device as described in claim 1 wherein said tension head for applying tension is disposed slidably in the radial direction of the ring-shaped frame along a slide rail.

3. A device as described in claim 1 wherein:

there are disposed a manual turning lever to apply tension to said tension head and a gut clamping plates clamping said gut; and said gut is clamped by said clamping plates while rotational torque of said lever displaces said clamping plates to pull said gut.

4. A device as described in claim 1 wherein a detachable tension maintainer is disposed on a disk of said frame base positioned below said frame and roughly parallel to an opening plane of said frame and having a size roughly identical to said opening of said frame, said tension maintainer maintaining the tension of said gut pulled using said tension head.

5. A device for stringing a gut for a racket having a ring-shaped frame with a plurality of gut holes formed in the frame, comprising:

a clamping mechanism for clamping at least one position of said ring-shaped frame of the racket;

an arm at one end attached to the clamping mechanism;

a bearing member attached at the other end of said arm and pivotally disposed at a position approximately at the center of said ring-shaped frame, said clamping mechanism configured to pivot around a position approximately at the center of said ring-shaped frame;

a disk attached to the bearing member through the arm for mounting said racket; and a tension head for applying tension to the gut through a gut hole; said tension head adapted to be disposed at an outer perimeter section of said ring-shaped frame for said tension head to slidably abut or move away from the outer perimeter section of said ring-shaped frame; when tension is applied to said gut, said tension head abuts said outer perimeter section of said ring-shaped frame and supports at least one section of said ring-shaped frame.

6. A device for stringing a gut according to claim 5, further comprising:

a tension maintainer for maintaining tension of the gut pulled by the tension head, said tension maintainer having magnets to magnetically attach to the disk.

7. A device for stringing a gut according to claim 5, further comprising:

a tension maintainer for maintaining tension of the gut pulled by the tension head, wherein said tension maintainer comprises:

a middle plate; said middle plate having legs with magnets attached at the end of the legs magnetically attach to the disk;

two clamping plates sandwiching said middle plate; and a tightening mechanism attached to the clamping plates for tightly securing the gut.

8. A device for stringing a gut according to claim 7, wherein said tightening mechanism comprises:

a shaft passing through the middle plate and the two clamping plates;

two cams disposed at the respective exterior sides of the clamping plates and engaged to the shaft, said cams formed as short cylindrical shapes and engaged eccentrically to the shaft;

a knob attached to one of the cams, wherein when said knob is turned, the two clamping plates are squeezed against the middle plate to secure the gut placed between the clamping plate and the middle plate.

9. A device for stringing a gut according to claim 5, further comprising:

a pedestal attached to the bearing member at an end opposite to the end attached to the arm, wherein said tension head comprises:

a sliding member to slidably engage with a slide rail formed in the pedestal;

a main unit a supported by the sliding member;

a puller rotatably supported by the main unit; and a gut clamping plates disposed on the outer perimeter of the puller.

10. A device for stringing a gut according to claim 5, further comprising:

a pedestal attached to the bearing member at an end opposite to the end attached to the arm, wherein said tension head comprises:

a sliding member to slidably engage with a slide rail formed in the pedestal;

a main unit supported by the sliding member;

a puller rotatably supported by a rotation shaft disposed in the main unit;

a turning lever attached to the puller to rotate the puller; and a gut clamping plates disposed on the outer perimeter of the puller, said gut clamping plates having projections for guiding the gut through the gut clamping plates.

11. A device for stringing a gut according to claim 5, further comprising:

a pedestal attached to the bearing member at an end opposite to the end attached to the arm, wherein said tension head comprises:

a sliding member to slidably engage with a slide rail formed in the pedestal;

a main unit supported by the sliding member;

a puller rotatably supported by a rotation shaft disposed in the main unit;

a turning lever attached to the puller to rotate the puller;

a scale provided next to the turning lever to indicate an amount of tension applied to the gut; and a gut clamping plates disposed on the outer perimeter of the puller, said gut clamping plates having projections for guiding the gut through the gut clamping plates.

* * * * *